United States Patent [19]

Gacsay et al.

[11] Patent Number: 4,875,506

[45] Date of Patent: Oct. 24, 1989

[54] YARN BRAKE FOR A WEFT YARN

[75] Inventors: Lorant Gacsay, Zurich; Beat Meierhofer, Jona, both of Switzerland

[73] Assignee: Sulzer Brothers Limited, Winterthur, Switzerland

[21] Appl. No.: 193,346

[22] Filed: May 12, 1988

[30] Foreign Application Priority Data

May 27, 1987 [CH] Switzerland ..... 02057/87

[51] Int. Cl.[4] ..... D03D 47/34

[52] U.S. Cl. ..... 139/450; 242/150 M; 188/65.1

[58] Field of Search ..... 242/149, 150 R, 150 M; 188/65.1, 65.2; 139/116, 429, 435, 450; 66/125

[56] References Cited

U.S. PATENT DOCUMENTS 3,633,711 1/1972 Pfarrwaller ..... 139/450

4,112,561 9/1978 Norris et al. .

FOREIGN PATENT DOCUMENTS 2452983 3/1976 Fed. Rep. of Germany .

3446567 5/1986 Fed. Rep. of Germany .

2300734 9/1976 France .

2568595 2/1986 France .

598981 3/1978 U.S.S.R. ..... 139/450

1097727 6/1984 U.S.S.R. .

*Primary Examiner*—Henry S. Jaudon

*Attorney, Agent, or Firm*—Kenyon & Kenyon

[57] ABSTRACT

The yarn brake includes a rigid brake element and a thin flexible metal foil brake element. Controllable electromagnets are provided for moving the metal foil towards the rigid brake element and for varying the braking force of the yarn brake. During braking, the yarn is braked gently over a relatively long length while the metal foil deforms about the yarn.

24 Claims, 3 Drawing Sheets

1
2
3
4
21
31
32
41
42
43
44
45
110
111
112
113
114
115
116
117

721
73
77
7150
77'
715
711'
711

73
75
715
VIII
VIII
71
7111
76
74
711
72
721
7

715
75
70
721
71
711
715'
711'
+
-

YARN BRAKE FOR A WEFT YARN

This invention relates to a yarn brake for a weft yarn. More particularly, this invention relates to an electronically controlled yarn brake.

Heretofore, various types of yarn brakes have been known for the braking of a weft yarn. For example, yarn brakes have been known wherein the braking force is controllable electromagnetically. Yarn brakes of this kind are used, for example, as weft yarn brakes for shuttleless looms such as projectile, gripper, water jet and air jet looms and, in general, wherever a yarn moves at a non-constant speed and where after movement of the yarn—i.e., overtaking of the picking element by parts of the yarn—must be eliminated. There are, for example, gripper looms in which a weft yarn is first accelerated by a giver, then decelerated towards a transfer position at the center of a shed, then accelerated again after transfer to a taker, then decelerated again. Ideally, what is required is a weft yarn brake which, at the timing of these accelerations and decelerations, releases the weft yarn completely unbraked in the acceleration phases, brakes the weft yarn fairly intensively in the deceleration phases and possibly clamps the yarn—i.e., retains the yarn by clamping—in other phases of the weaving cycle.

Japanese Pat. No. 23014/82 and USSR patent specification SU 1 097 727 disclose, for example, electromagnetically controllable disc brakes. However, the discs and actuating levers for these brakes are relatively heavy. As a result, the response times for variations in braking force are lengthy or expensive constructional steps for magnet windings are required. Also, because of the short switching times and relatively large weights, high forces and heavy wear arise, for example, in the striking of the moving disc in opening and in the release of the yarn brake.

German Patent No. 34 46567 describes a weft yarn brake wherein the yarn is braked between two lamellae resembling spring strips and wherein the braking force can be increased controllably by means of supplementary electromagnets. The basic setting of the spring strip brake is adjustable and predetermined by the preloading of the spring strips. The yarn is braked by a relatively short part of the spring strips at that end thereof which is remote from the mounting. The amplifying electromagnets are disposed in this region also and so the braking force is always provided by this short and almost point-like end zone. The yarn experiences virtually point loading in an arrangement of this kind so that surface pressures on the yarn are high. If the weft yarn is very irregular and there are faults in the yarn, the instantaneous loading of the yarn in the braking zone may so vary that the yarn may either rupture or conversely be inadequately braked, in both cases with a disturbing and unwanted effect.

French Patent No. 2 300 734 discloses an air type yarn brake having a supplementary electromagnetic brake. The supplementary brake is in the form of a resilient spring-like lamella which, when de-energized, does not contact the yarn and leaves a gap so that the yarn is not braked. The function of the brake is to stop and retain the yarn at the end of picking. Upon actuation of the supplementary brake, the resilient lamella is attracted and the yarn is clamped between the lamella and a plate. The yarn is clamped transversely to the direction of movement substantially linearly and, therefore, experiences severe local stressing. Graduated braking of the yarn cannot be provided when the yarn is very irregular and, more particularly, because of the pull-on characteristic of a resilient lamella and a magnet.

Accordingly, it is an object of the invention to provide an electromagnetic brake of inexpensive construction for a weft yarn.

It is another object of the invention to provide an electromagnetic yarn brake which imposes a relatively gentle force on a weft yarn during braking.

It is another object of the invention to provide a reliable electronically controlled yarn brake for braking weft yarns without imposing inadequate braking forces thereon.

Briefly, the invention provides a yarn brake for a weft yarn which is comprised of an elongated rigid brake element, a flexible strip-like brake element of at least partly ferromagnetic material and a magnet means for selectively moving the flexible braking element towards the rigid brake element to brake a weft yarn therebetween.

The brake elements are substantially flat and are disposed in the direction of movement of the yarn to be braked. During braking, the brake elements act over a substantial proportion of their length corresponding to more than their width relative to the direction of movement of the yarn.

The magnet means includes a plurality of electromagnets in the rigid brake element for forming a magnetic circuit with the flexible brake element. These electromagnets are controllable in order to vary the forces operative between the brake elements and on the yarn.

The flexible brake element which is made of a metal foil, for example, is disposed so as to rest on the yarn over much of the length of the element, at the most, by its own weight when in a non-braking condition.

The yarn brake may be used in any environment for the braking of a yarn, for example, as a weft yarn brake in a shuttleless loom.

The yarn brake has rapid response times and still remains controllable at very high yarn speeds which, for example, in the case of shuttleless high-performance looms can be in the region of 50 meters/per second and more. Since the braking force is transmitted to the yarn over a considerable yarn length of, for example, several centimeters, the specific surface pressure experienced by the yarn for a given braking force is reduced considerably. Thus, yarn braking is easier on the yarn than the braking provided by known yarn brakes. More particularly, the high specific surface loading of the yarn in braking which is a nuisance with conventional yarn brakes disappears. The reduced specific stressing of the brake elements also helps to lengthen the working life of the yarn brake. Also, in this yarn brake, the braking force is affected much less than previously by yarn irregularity. A number, for example, two or three, lamella-like brake foils can be disposed one above another, the foils being disposed either freely one above another or being interconnected. This provides a means for increasing the maximum braking force with the same magnet current, something which may be advantageous for relatively coarse yarns.

That side of the flexible foil which is remote from the yarn can have a very light and virtually weightless plastics coating, for example, a foam, something which may facilitate handling of the foil and reduce the risk of operatives suffering injuries by cuts. A number of yarn bakes can be combined to form a multiple weft yarn brake with, for example, joint control.

These and other objects and advantages of the invention will become more apparent from the following detailed description taken in conjunction with the accompanying drawings wherein:

FIG. 1 illustrates a perspective view of a diagrammatically shown yarn brake in accordance with the invention, having three controllable magnet coils;

FIG. 1*a* diagrammatically illustrates an arrangement of a weft yarn brake on a shuttleless loom;

Figure 5:
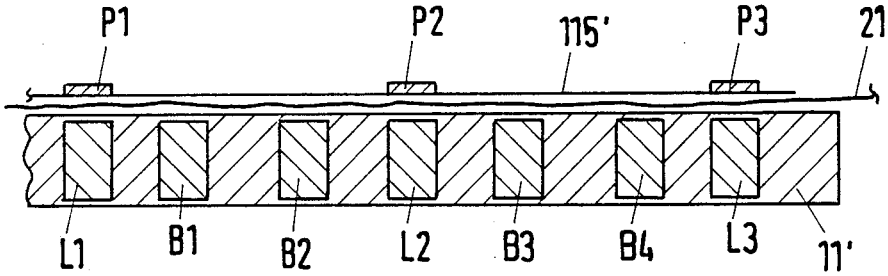
Figure 6:
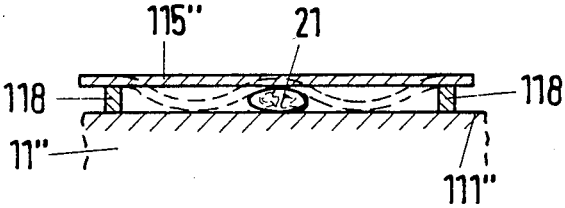
Figures 7, 8, 9:
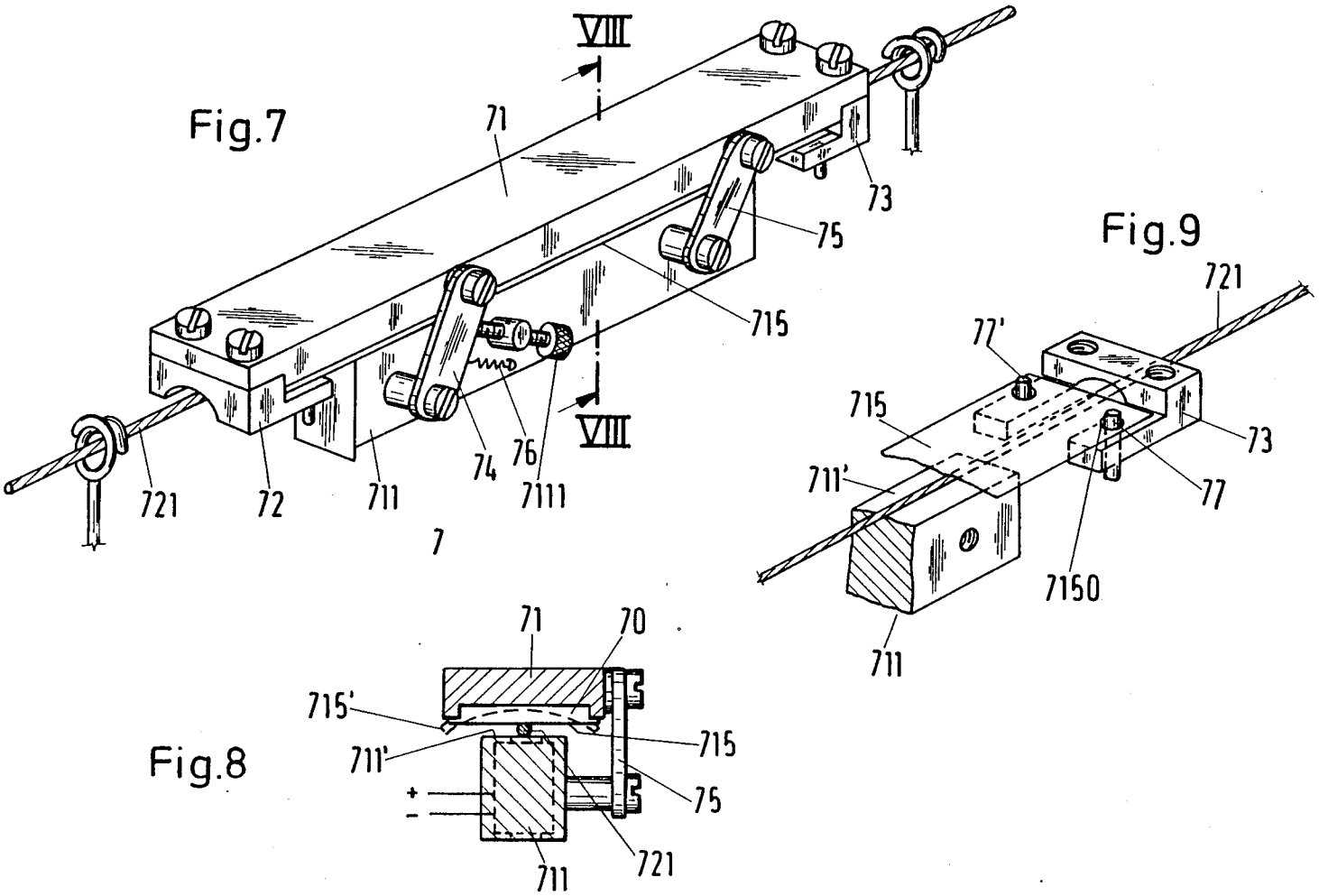

FIG. 5 diagrammatically illustrates another example of an arrangement of magnet members and braking members in a yarn brake according to the invention;

FIG. 6 illustrates a diagrammatic cross-sectional view of another embodiment of a yarn brake having spacing elements between the brake elements;

FIG. 7 illustrates a modified yarn brake wherein the brake elements may be adjusted relative to each other in accordance with the invention;

FIG. 8 illustrates a view taken on line VIII—VIII of FIG. 7; and

FIG. 9 illustrates a mounting arrangement of a metal foil brake element in the brake of FIG. 7.

Figures 1, 1A:
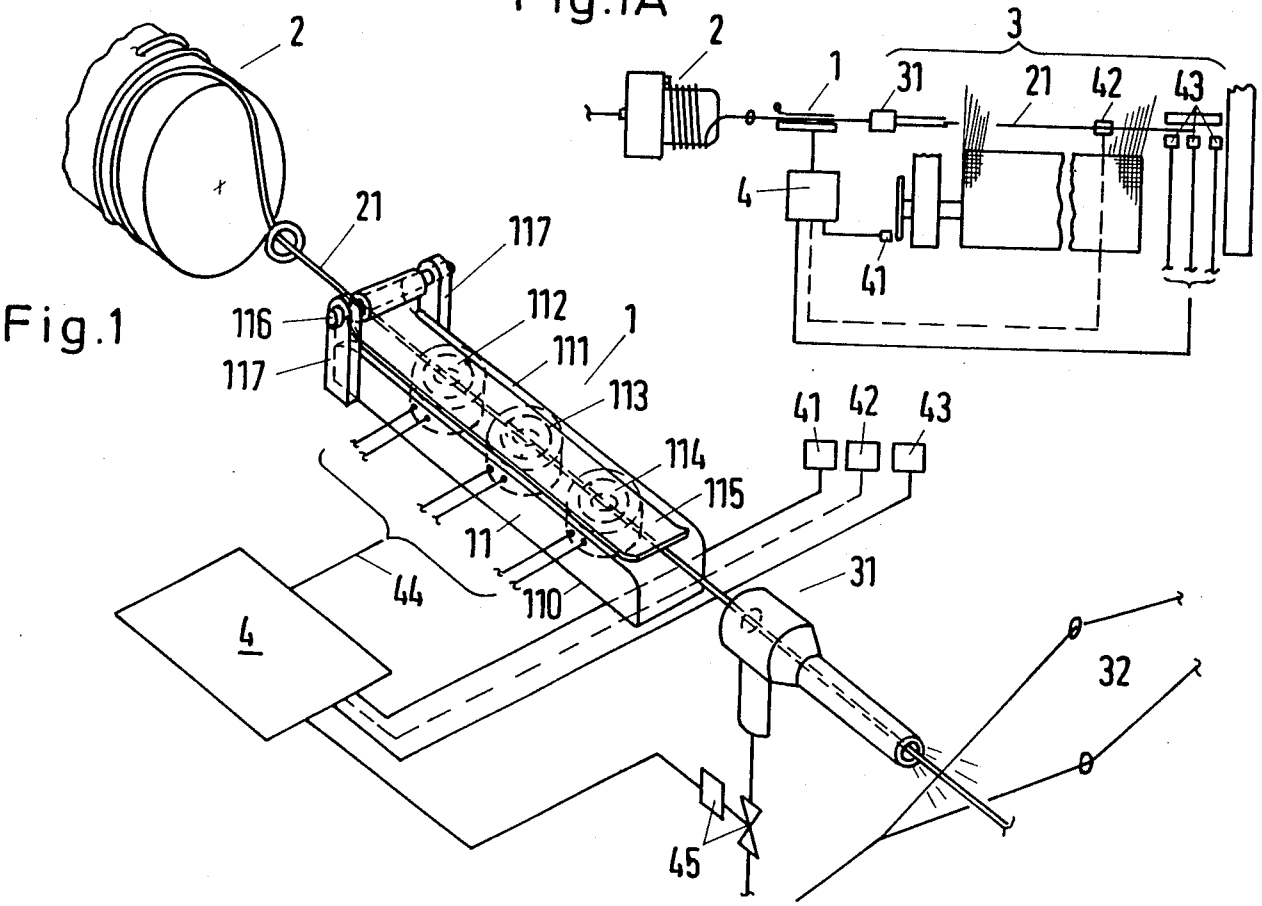

Referring to FIG. 1, the yarn brake 1 is disposed as a weft yarn brake between a weft yarn store 2 and a main nozzle 31 of a loom 3 for the braking of a weft yarn 21. The particular shuttleless picking method used to pick the weft yarn 21 into a schematically shown shed 32 is of no importance for the following description.

Figure 2:
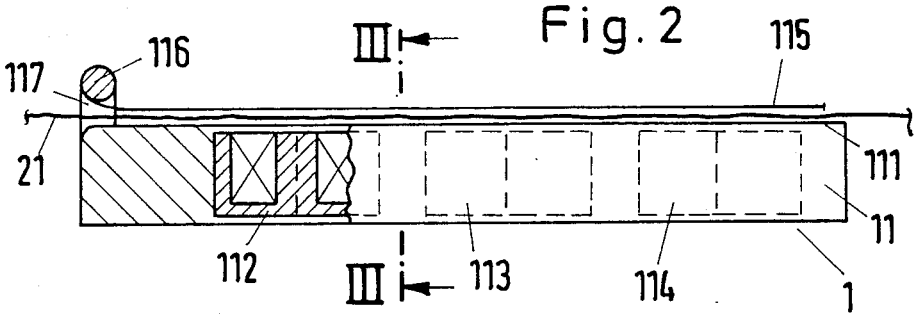
FIG. 2 illustrates a side view of the yarn brake of FIG. 1.

Referring to FIGS. 1 and 2, the yarn brake 1 includes an elongated rigid brake element 11 having a surface 111 facing the weft yarn 21 which is provided with an abrasion resistant surface coating.

In addition, the brake 1 has a magnet means formed of a plurality of controllable electromagnets 112, 113, 114, for example, cast in a casing 110 which is, for example, a section or molding of plastics, non-ferromagnetic metal, ceramic, glass or some other non-ferromagnetic material and disposed in the rigid brake element 11. The magnets 112–114 of the example shown are pot or remanent magnets having a low-iron core, with a short switching time of, for example, six milliseconds or less.

The brake 1 has a flexible strip-like brake element 115 made of ferromagnetic metal foil which is pulled by the magnets 112–114, when the same are energized, towards the rigid brake element 11. The ferromagnetic foil 115 is effective as an armature for the magnets 112–114 so as to complete a magnet circuit with the magnets 112–114. In use, the weft yarn experiences a braking force which can be varied and controlled by means of the magnetic force of the controllable electromagnets 112–114.

Figure 4:
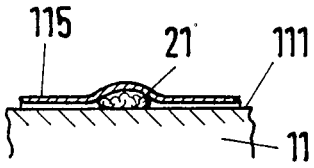
FIG. 4 illustrates a view on an enlarged scale of a detail of FIG. 3 with the brake in action.

The foil 15 is secured at one end to the rigid brake element 11 in cantilever manner by suitable securing means for example, the foil 15 is rigidly secured to a spindle 116 secured in bores in two uprights 117 fixed to the rigid brake element 11. The foil 115 is slightly preloaded in the example shown although because of the very low bending moment of the foil, the preloading contributes virtually nothing to the braking force. All that the preloading does is to ensure that the foil 115 engages the yarn and that flutter of the foil 115 is opposed. An important consideration is that the foil 115, which is of very reduced mass and therefore almost weightless, should engage over most of its length with the rigid braking surface 111 of the rigid brake element 11 or rest on the yarn 21, at the most, by its own weight. The braking force is provided substantially exclusively by the electromagnets 112–114 when they attract the foil 115 with varying intensity. In braking, the foil 115 deforms transversely to the direction of yarn movement and wraps around the yarn over a relatively large angular range, as shown in FIG. 4, and as described with reference thereto. When the yarn brake is released—i.e., when the electromagnets 112–114 are in the de-energized state—the virtually weightless foil 115 contacts the yarn 21 purely linearly and so the yarn 21 is virtually unbraked.

Referring to FIG. 1*a*, control electronics 4 for the yarn brake 1 and main nozzle 31 vary the braking force acting on the yarn 21, for example, in dependence upon the position of the tip of the weft yarn 21 in the shed 32 and upon the angle of loom rotation. The performances of many loom functions are defined with reference to the angle of rotation of the main drive shaft. By means of a sensor 41, the electronics 4 detect such angle, for example, continuously. A sensor 42 determines the time at which the weft yarn tip passes by a particular position in the shed 32 and can, for example, transmit a weft yarn movement signal to the electronics 4. Three sensors 43 monitor the weft yarn in the final phase of picking, the yarn either providing the signal directly or the picking element providing the signals from the sensors 41–43, the control electronics 4 can determine the instantaneously necessary braking force and vary the power of the braking magnets 112–114 by way of inputs 44 and adapt such power to the respective requirements. Each magnet 112, 113, 114 can be controlled separately or the magnets can be connected in series and controlled in the same sense. Another possibility would be for magnets to be combined for control purposes into groups of serially connected magnets. In the illustrated example, two magnets, for example, 112 and 114, could be connected in series and the third magnet 113 could be connected in parallel to them. In the example shown, the control eleotronics 4 is also responsible for controlling a valve 45 of the main nozzle 31. The control electronics 4 for the yarn brake 1 can be an independent unit or a part, for example, of a central control electronics can be fully integrated therein.

Referring to FIG. 2, the surface 111 which is near the yarn 21 co-operates with the lamella-like ferromagnetic metal foil 115 to form the actual yarn brake. The foil 115 can be, for example, a steel lamella having a thickness of a few hundredths of a millimeter, for example, of from 5 to 50 hundredths of a millimeter. Foils of non-crystalline metal belonging to the category of rapidly solidified products (RSP) have proved very satisfactory; they combine great wear resistance with good magnetic properties. A layer of RSP, although not ferromagnetic, with high wearing resistance would also make a suitable surface coating for the surface 111 near the yarn 21—i.e., for the braking surface of the rigid brake element 11.

A yarn brake having a single elongated strip-like magnet acting magnetically on the metal foil 115 over much of the length thereof could also be used.

Figure 3:
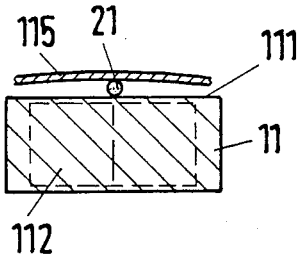
FIG. 3 illustrates a view on line III—III of FIG. 2.

Referring to FIG. 3, when in the de-energized state, the virtually weightless metal foil 115 rests on the yarn 21 and the same experiences virtually zero braking.

When the magnets 112–114 are energized, the foil 115 deforms, in the manner shown in FIG. 4, so that the angle by which the foil wraps around the yarn 21 increases and/or the yarn 21 is so flattened that the contact area between the yarn 21 and the braking surface 111 and the metal foil is increased. Because of the larger braking area, the yarn 21 is treated very carefully. Since the braking force is applied to the yarn 21 over a considerable length of, for example, five or more centimeters and since the metal foil 115 is to some extent, adapted to yarn cross-section, variation in time of the braking force such as can be caused, for example, by irregularities in the yarn diameter is less than, for example, in the case of disc brakes or spring strip brakes where the entire braking force is applied over a relatively short length of yarn and the brake members are heavier and therefore have more inertia than in the case of the yarn brake 1.

Referring to FIG. 5, the yarn brake may be constructed such that the rigid brake element 11; receives, in addition to four magnet coils B1, B2, B3 and B4, which are the braking magnets, three release coils L1, L2, L3. In addition, permanent magnets P1, P2, P3 are disposed on the foil 115 opposite the coils L1–L3 on the side remote from the yarn 21. With the magnets B1–B4 de-energized and if the coils L1–L3 are correctly polarized i.e., if like poles of permanent magnets and release coils are opposite one another, the metal foil 115 can be disengaged completely from the yarn. That is, the yarn brake can be fully released with the permanent magnets moving the foil 115 from the rigid brake element 11. Reversing the polarity of the release coils L1–L3 would enable the same to provide braking forces. The permanent magnets P1–P3 increase the rigidity of the metal foil 115 in the zone where they are disposed but foil flexibility between the permanent magnets and, therefore, the gentle braking properties remain substantially the same. Also, there are flexible permanent magnet materials which cause very little increase in foil rigidity. The additional weight of the foil 115 due to the permanent magnets P1–P3 can, if required, be compensated for by the release coils L1–L3.

Referring to FIG. 6, spacing elements 118 may be disposed between the brake elements 11'', 15'' and along both longitudinal sides of the brake elements 11'', 115''. These spacing elements 118 form a gap between the foil 115'' and the braking surface 111'' of the rigid braking element 11'' for unbraked movement of the yarn 21. When the braking magnets (not shown) which are disposed, for example, between the spacing elements 118 as considered in the direction of yarn movement, are energized, the yarn 21 is braked in the manner described above. If spacing elements 118 are also present near the braking magnets, the metal foil 115'' is deformed and adapts itself to the yarn 21 transversely to the direction of yarn movement, for example, in the manner shown in chain lines in FIG. 6.

Referring to FIG. 7, the yarn brake 7 may be constructed of the rigid brake element 711, a metal foil 715 and an elongated support 71 which extends in parallel over the rigid brake element 711. As indicated, the support 71 has fastening means disposed at each end for securing the flexible brake element 715 to the support 71 in parallel relation. For example, each fastening means includes an L-shaped mounting bracket 72, 73, each of which is secured to the support 71 by a pair of bolts. As indicated in FIG. 9, the mounting bracket 73 carries a pair of pins 77, 77' which fit into openings 7150 in the metal foil 715. A similar arrangement is provided in the other bracket 72 (not shown). In this mounting arrangement, the metal foil 715 does not have to be clamped between the brackets 72, 73 and the support 71. The openings which fit over the mounting pins may be oversized so that the foil rests freely and moveably and only with part of its own weight and only periodically on the yarn 721.

Alternatively, the metal foil may be fastened only at the beginning end relative to the direction of travel of the yarn. In this case, the metal foil may be clamped between the support 71 and the mounting brackets 72.

Referring to FIG. 8, the support 71 is provided with a longitudinal recess 70 which faces the metal foil 715 for receiving at least a portion of the foil 715. This recess 70 allows the passing of thick points in the yarn 721 without the tension of the yarn being unduly increased. In this case, the metal foil 715 deforms into the position 715' as indicated by the dotted line. During braking, the metal foil 715 may adapt to the yarn 721 under the effect of magnetic forces in a manner similar to that illustrated in FIG. 6.

Referring to FIGS. 7 and 8, a means is also provided for adjusting the support 71 relative to the rigid brake element 711. As illustrated, this means includes a pair of pivotal levers 74, 75 which are pivotally connected via bolts to the rigid brake element 711 and a support 71. In addition, a spring 76 is provided between one lever 74 and the rigid brake element 711 to bias the lever 74 against an adjusting screw 7111. By turning the screw 7111, the angle of the levers 75, 76 may be changed so that the distance between the metal foil 715 and the braking surface 711' of the rigid brake element 711 can be adjusted. As indicated in FIG. 8, the distance between the foil 715 and the brake surface 711' can be chosen approximately in the size of the diameter of the yarn 721.

The invention thus provides a yarn brake which is able to brake yarns very gently over a relatively long length of the yarn. Further, the invention provides a yarn brake wherein irregularities in the thickness of the yarn to be braked have a minimal effect on the braking force.

What is claimed is:

1. A yarn brake for a weft yarn comprising an elongated rigid brake element;

a flexible strip-like brake element of at least partly ferromagnetic material disposed opposite said rigid brake element to receive a length of weft yarn longitudinally therebetween; and a magnet means for selectively moving said flexible brake element towards said rigid brake element to brake a weft yarn therebetween.

2. A yarn brake as set forth in claim 1 wherein said magnet means includes a plurality of electromagnets in said rigid brake element for forming a magnetic circuit with said flexible brake element.

3. A yarn brake as set forth in claim 2 wherein each electromagnet is a pot magnet having a low-iron core.

4. A yarn brake as set forth in claim 1 wherein said flexible brake element is a metal strip having a thickness of from 5 to 50 hundredths of a millimeter.

5. A yarn brake as set forth in claim 1 wherein said flexible brake element is made of rapidly solidified products.

6. A yarn brake as set forth in claim 1 wherein said magnet means includes at least two controllable electromagnets connected in series.

7. A yarn brake as set forth in claim 1 wherein said magnet means includes at least two controllable electromagnets connected in parallel.

8. A yarn brake as set forth in claim 1 wherein said magnet means includes at least two controllable electromagnets connected in series.

9. A yarn brake as set forth in claim 1 wherein said magnet means include controllable electromagnets having a switching time of less than 6 milliseconds.

10. A yarn brake as set forth in claim 1 wherein said magnet means include a plurality of controllable electromagnets for attracting said flexible brake element towards said rigid brake element and a plurality of permanent magnets for moving said flexible brake element away from said rigid brake element.

11. A yarn brake as set forth in claim 1 which further comprises an abrasion resistant coating on at least one brake element facing the other brake element.

12. A yarn brake as set forth in claim 1 wherein each brake element has a weft yarn contact surface of at least 5 centimeters.

13. A yarn brake as set forth in claim 1 which further comprises a securing means for securing said flexible brake element at one end to said rigid brake element in cantilever manner.

14. A yarn brake as set forth in claim 1 which further comprises spacing elements disposed between said brake elements and along each longitudinal side of said brake elements.

15. A yarn brake as set forth in claim 1 wherein said magnet means includes a magnet strip having a plurality of electromagnets therein.

16. A yarn brake as set forth in claim 1 which further comprises a coating of low-weight plastic material on a side of said flexible brake element remote from said rigid brake element remote from said rigid brake element.

17. A yarn brake as set forth in claim 1 which further comprises an elongated support and fastening means for securing said flexible brake element to said support in parallel relation.

18. A yarn brake as set forth in claim 17 wherein said fastening means is disposed at least one end of said support.

19. A yarn brake as set forth in claim 17 wherein said support has a longitudinal recess facing said flexible brake element for receiving at least a portion of said flexible brake element therein.

20. A yarn brake as set forth in claim 17 which further comprises means for adjusting said support relative to said rigid brake element.

21. A yarn brake as set forth in claim 1 wherein said flexible brake element is a metal foil.

22. A yarn brake as set forth in claim 1 wherein said magnet means is on the same side of the yarn as said rigid brake element.

23. A yarn brake as set forth in claim 1 wherein said flexible brake element is secured at one end to said rigid brake element in cantilevered manner.

24. A yarn brake for a weft yarn comprising an elongated rigid brake element;

at least one light-weight flexible strip-like brake element of metal foil disposed opposite and parallel to said rigid brake element; and a controllable magnet means for selectively moving said flexible brake element towards said rigid brake element to deform about and brake a weft yarn extending longitudinally in parallel therebetween.

* * * * *

UNITED STATES PATENT AND TRADEMARK OFFICE

CERTIFICATE OF CORRECTION

PATENT NO. : 4,875,506

DATED : October 24, 1989

INVENTOR(S) : LORANT GACSAY

It is certified that error appears in the above-identified patent and that said Letters Patent is hereby corrected as shown below:

Column 4, line 44 "eleotronics" should be -electronics-

Signed and Sealed this

Twenty-first Day of May, 1991

*Attest:*

HARRY F. MANBECK, JR.

*Attesting Officer*

*Commissioner of Patents and Trademarks*